US008766751B2

(12) United States Patent
LaFountain et al.

(10) Patent No.: US 8,766,751 B2
(45) Date of Patent: Jul. 1, 2014

(54) PROXIMITY SWITCH

(71) Applicant: General Equipment and Manufacturing Company, Inc., Louisville, KY (US)

(72) Inventors: Robert Lynn LaFountain, Charlestown, IN (US); Gregory Curtis Merrifield, Prospect, KY (US)

(73) Assignee: General Equipment and Manufacturing Company, Inc., Louisville, KY (US)

( * ) Notice: Subject to any disclaimer, the term of this patent is extended or adjusted under 35 U.S.C. 154(b) by 0 days.

(21) Appl. No.: 13/728,398

(22) Filed: Dec. 27, 2012

(65) Prior Publication Data

US 2013/0169388 A1 Jul. 4, 2013

Related U.S. Application Data

(60) Provisional application No. 61/580,833, filed on Dec. 28, 2011.

(51) Int. Cl.
*H01H 36/00* (2006.01)

(52) U.S. Cl.
CPC ..... *H01H 36/0073* (2013.01); *H01H 36/00* (2013.01)
USPC ..... 335/205; 335/207

(58) Field of Classification Search
CPC ..... H01H 36/00; H01H 36/0073
USPC ..... 335/205–207; 324/207.11–207.26
See application file for complete search history.

(56) References Cited

U.S. PATENT DOCUMENTS

| | | | | |
|---|---|---|---|---|
| 3,219,811 | A | 11/1965 | Young | |
| 4,117,431 | A * | 9/1978 | Eicher | 335/207 |
| 4,788,517 | A | 11/1988 | Meister | |
| 4,837,539 | A * | 6/1989 | Baker | 335/207 |
| 5,798,910 | A | 8/1998 | Holbeche et al. | |
| 6,127,910 | A * | 10/2000 | Webb et al. | 335/205 |
| 6,299,426 | B1 | 10/2001 | Scanlan | |
| 6,614,335 | B2 * | 9/2003 | Buck | 335/205 |
| 6,805,569 | B2 * | 10/2004 | Buck | 439/310 |
| 6,857,902 | B2 * | 2/2005 | Mehnert et al. | 439/579 |
| 7,489,217 | B2 * | 2/2009 | Rohrig et al. | 335/205 |
| 8,362,859 | B2 * | 1/2013 | Pearce et al. | 335/205 |
| 8,439,404 | B2 * | 5/2013 | Anton et al. | 285/93 |

FOREIGN PATENT DOCUMENTS

| | | |
|---|---|---|
| DE | 102 37 904 A1 | 1/2004 |
| GB | 1 217 677 A | 12/1970 |

OTHER PUBLICATIONS

International Search Report for PCT/US2012/070798, dated Jun. 3, 2013.
Written Opinion for PCT/US2012/070798, dated Jun. 3, 2013.

* cited by examiner

*Primary Examiner* — Ramon Barrera

(57) ABSTRACT

Proximity switches are disclosed that preferably are provided in a hermetically sealed unit that can be used in harsh environments and under significant pressures, such as underwater and in nuclear power facilities, without having any parts that would require replacement or periodic maintenance. The proximity switches are preferably switches actuated by physical movement of a contact in response to changing magnetic forces. The switches are preferably disposed in a body tube optionally including a hermetic seal assembly to seal an open end of the body tube and/or a ferrule that prevents electrical wires attached to the switch inside the body tube from being pulled away from the switch. Further, the switches preferably maintain a contact pressure between electrical contacts sufficient to withstand acceleration seismic testing of 10 g with no contact discontinuity.

22 Claims, 3 Drawing Sheets

PROXIMITY SWITCH

FIELD OF THE DISCLOSURE

The disclosure relates generally to proximity switches.

BACKGROUND

Magnetic proximity switches are used in many and varied operational environments to provide a changing electrical signal depending on the proximity of some target to the switch. Magnetic proximity switches may be used in an almost infinite number of different applications. In one common application, for example, a magnetic proximity switch may be used in conjunction with a valve to sense when the valve is in an open or closed position.

One typical magnetic proximity switch includes, in a very basic arrangement, a common electrical contact that is movable between two different contacts to complete either a first circuit or a second circuit. The common contact is attached to or includes a ferrous or magnetic sensing member that will shift in a first direction when a target, such as another magnet or ferrous structure, approaches within a certain distance, or sensing range, of the sensing member. Typically, the sensing member and/or the common contact is also biased to shift in an opposite, second direction when the target retreats away from the sensing member beyond the sensing range.

Proximity switches are often used in very harsh operating environments, such as under water and in dirty environments in which abrasives, such as dirt, metal shavings, and/or caustic chemicals, are present. A few exemplary harsh operating environments include, without limitation, deep sea oil and gas extraction, chemical and petrochemical refineries, heavy industrial plants such as steel mills and heavy manufacturing and machining operations, sandy desert environments, and so on.

In addition, proximity switches are often used in environments where fail-safe operation is of a top priority, such as in nuclear power generation plants, and in which any equipment used in such environments must meet elevated operating specification in order to prevent malfunctioning under even extreme operating conditions. In nuclear applications, for example, some such specifications are intended to prevent malfunctioning of components under elevated seismic acceleration loading.

SUMMARY

According to one aspect, a proximity switch has a body tube having a blind bore, a closed end, and an open end; a magnetic proximity switch assembly disposed inside the blind bore; a hermetic seal covering the blind bore between the magnetic proximity switch assembly and the open end; a crush ring disposed against an annular shoulder defined in a surface of the blind bore between the hermetic seal and the open end; a crush ring compression device having a threaded plug body that screws into the open end of the blind bore and sealingly engages the crush ring; and a potting filling any space between the crush ring compression device and the hermetic seal; wherein the hermetic seal, the potting, and the crush ring compression device seal the blind bore and protect the magnetic proximity switch during pressurization and submergence testing. The crush ring optionally may be in the form of a hollow tube having a circular longitudinal axis. The hermetic seal optionally can include a disc sized and shaped complementary to the blind bore, and a tube extending through the disc, wherein the tube has a first end adjacent the magnetic proximity switch and receiving an electrical contact therein, and wherein an outer annular periphery of the disc is sealed to an inner surface of the blind bore. A second tube may extend through the disc, and the second tube can receive a second electrical contact therein. In another option, an electrical cable electrically is connected with the magnetic proximity switch assembly and extends from the hermetic seal through the crush ring compression device, wherein the electrical cable is electrically coupled to the tube. The crush ring compression device optionally has a central bore, wherein the electrical cable extends through the central bore. The central bore also may include a cylindrical portion and a first tapered portion extending from the cylindrical portion to a first end of the plug body engaged against the crush ring, wherein the crush ring compression device compresses the potting into the central bore.

According to another aspect, a proximity switch includes a body tube having bore with an open end; a proximity switch assembly disposed inside the bore; a plug having a body that fits inside the open end and locks against an annular wall of the bore, the plug body having a second bore therethrough; an electrical lead electrically coupled with the proximity switch assembly and extending through the second bore; a ferrule surrounding the electrical lead and disposed inside the second bore; and a jam nut coupled with the plug and urging the ferrule into sealing contact with the second bore and locking the electrical lead in a fixed position within the second bore. In one option, the ferrule has a tapered nose that is wedged within the second bore. The plug optionally includes a nipple extending from an exterior end of the plug body axially opposite the proximity switch assembly, wherein the second bore has a tapered portion extending through the nipple, and the ferrule is wedged into the tapered portion by the jam nut. In another option, the nipple has exterior threads, and the jam nut screws onto the exterior threads. The tapered portion may form a conical bore. In one arrangement, the ferrule optionally is at least partly made of Poly Ether Ether Ketone. In another option, the ferrule sealingly engages the second bore and the electrical lead thereby forming a seal around the electrical lead in the second bore. The jam nut may optionally have an inward radial flange that engages the ferrule.

According to yet another aspect, a proximity switch assembly includes a primary magnet; a plunger including a piston head spaced from the primary magnet and a piston rod connecting the piston head and the primary magnet; an electrical contact carried by the piston head and arranged to open and/or close an electrical circuit upon movement of the piston head; and a biasing magnet located adjacent the piston rod between the primary switch and the piston head. The biasing magnet is arranged to bias the primary magnet axially along the piston rod either toward or away from the biasing magnet, the plunger and the primary magnet are arranged to move axially in relation to the biasing magnet, and no flux sleeve is disposed between the primary magnet and the biasing magnet. In one option, the primary magnet is carried by a retainer attached to the piston rod, the biasing magnet is carried within a retainer body comprising a wall disposed between the biasing magnet and the retainer, and no spacer or ferrous material is disposed between the wall and the retainer.

According to additional aspects, all functionally possible different combinations of components and features shown and described herein are expressly included as additional aspects of the disclosure and contemplated as being separable and individual technological developments that may be combined in various arrangements not expressly shown in the drawings. Other aspects and advantages of the present disclosure will become apparent upon consideration of the following description.

DETAILED DESCRIPTION

Proximity switches according to some aspects of the present disclosure preferably are provided in a hermetically sealed unit that can be used in harsh environments and under significant pressures, such as underwater and in nuclear power facilities, without having any serviceable parts that would require replacement. Further, the proximity switches according to other aspects of the disclosure preferably maintain a contact pressure in both the first and second positions to withstand acceleration seismic testing of 10 g with no contact discontinuity. Each proximity switch preferably includes a switch assembly that includes an array of magnets disposed near a face of the switch to create an internal magnetic bias to maintain the switch in a normal first position that completes a first circuit. The first circuit can be either a normally open or a normally closed circuit depending on how the switch assembly is wired. When the internal magnetic bias is interrupted or overpowered, such as by a target made of ferrous metal or preferably magnetized material moved to within a certain distance of the face of the switch, the change in bias causes a set of electrical contacts to shift to a second position that completes a second circuit as long as the target is within the certain distance. When the target is removed from the face of the switch, the array of magnets causes the switch to shift back to the first position and thereby switch back to the first circuit again. As a result, each proximity switch snaps positively between the first and second positions, thereby minimizing or eliminating flutter. Other types of switch assemblies may be used according to some aspects of the present teachings.

Figure 1:
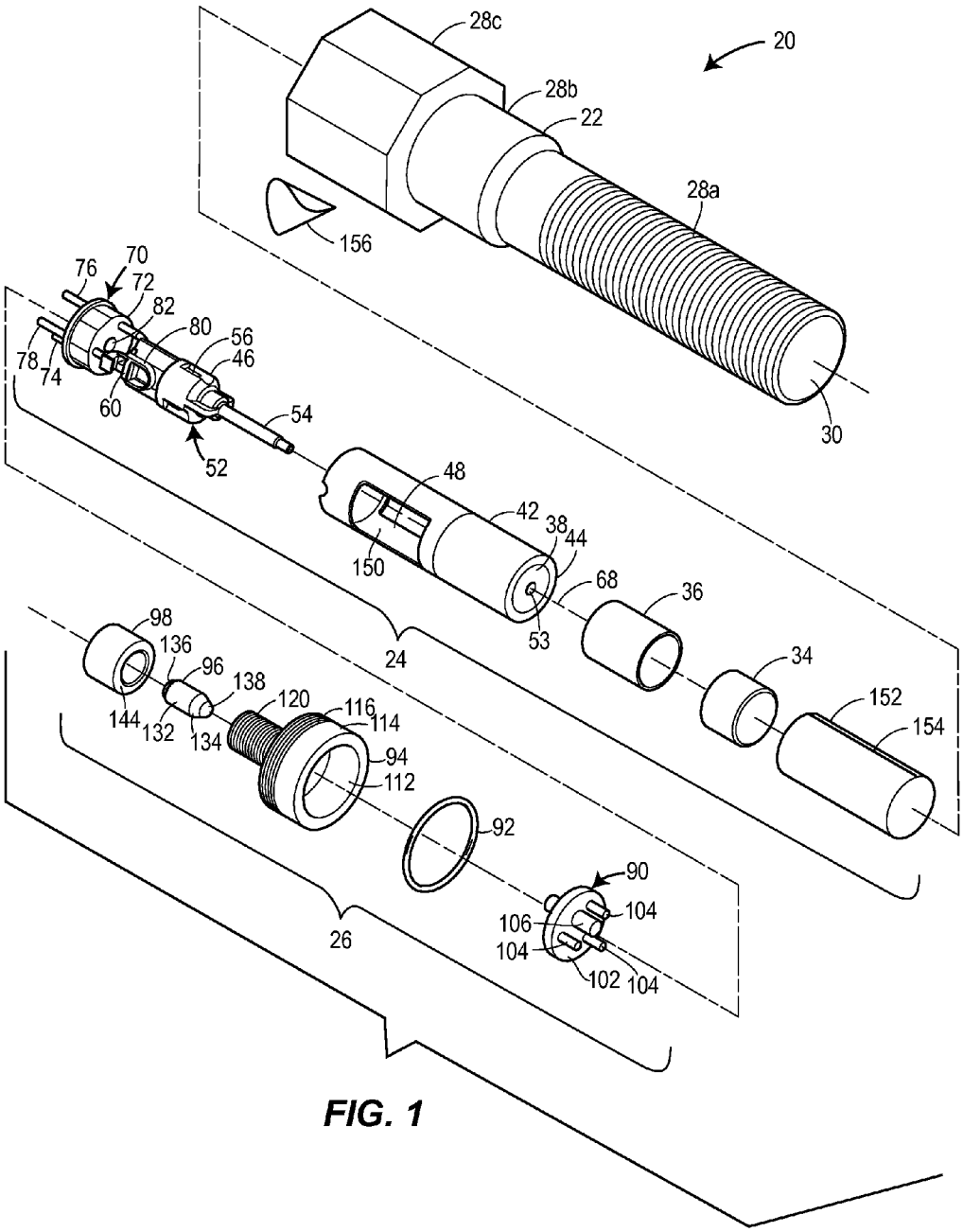
FIG. 1 is an isometric exploded view of a proximity switch according to the principles of the disclosure.
Figure 2:
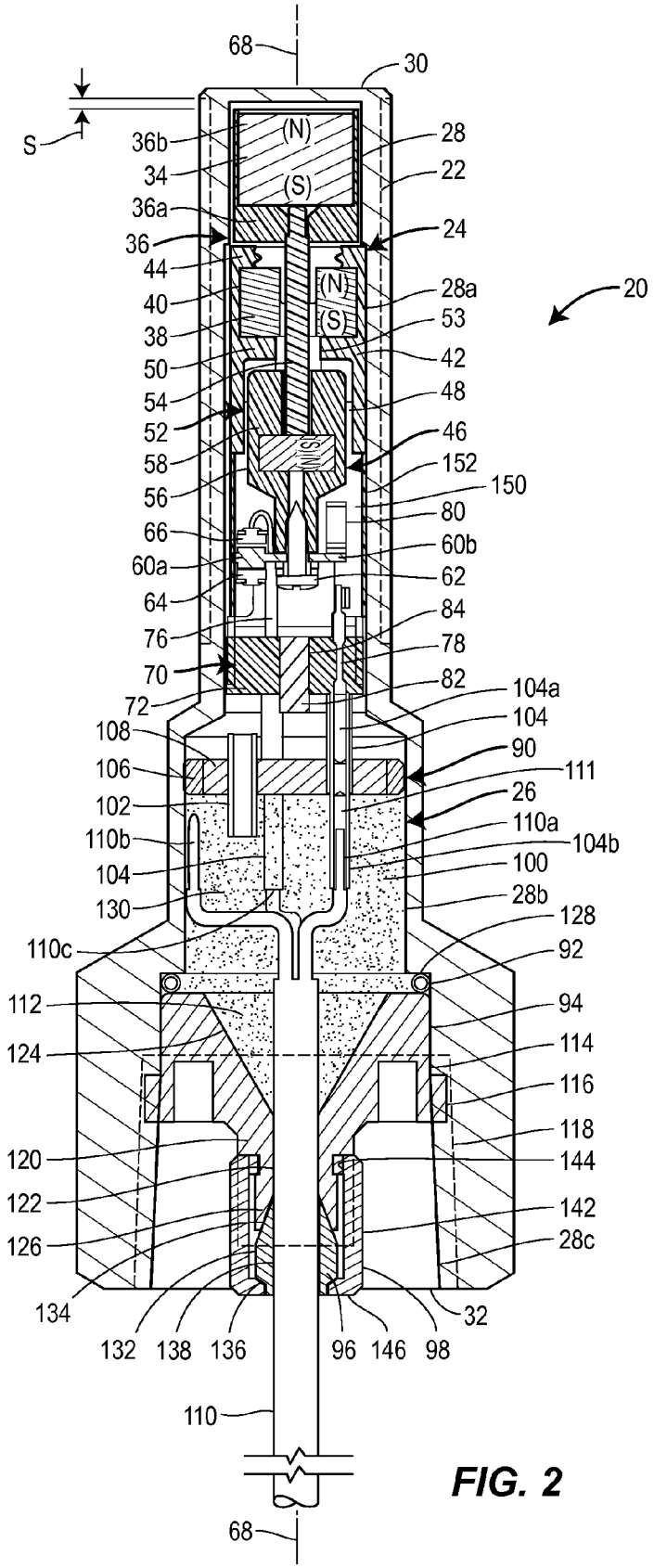
FIG. 2 is a cross-sectional view along a longitudinal axis of the of the proximity switch of FIG. 1.

Turning now to the drawings, FIGS. 1 and 2 show a proximity switch 20 in one embodiment according to the general principles of the present disclosure. The proximity switch 20 includes a body tube 22, a switch assembly 24 that is received inside the body tube, and an optional end seal assembly 26 that hermetically seals the switch assembly within the body tube.

The body tube 22 is an elongate hollow tubular member with a blind inner bore 28 extending from a closed end 30 to an open end 32. The body tube 22 and the inner bore 28 preferably have a first section 28*a* that extends from the closed end, a second section 28*b* extending from the first section, and third section 28*c* extending from the second section to the open end 32. The first section 28*a* has a first inner diameter sized to receive the switch assembly 24, the second section 28*b* has a second inner diameter larger than the first diameter, and the third section 28*c* has a third diameter larger than the second diameter. The second and third diameters are sized to receive different portions of the end seal assembly 26 as explained in detail below. The outer surface of the body tube 22 preferably has the shape of a stud with a middle portion between a threaded shaft and a head, each corresponding to one of the sections 28*a-c*. Preferably, the outer surface along the first section 28*a* is threaded in order to be threadedly received within a bore of, for example, a valve body, cylinder head, or any other item that is adapted to use a proximity switch as would be apparent to one of ordinary skill. The outer surface along the second section 32*b* may be generally cylindrical, as shown in the drawing, or have another shape. The outer surface along the third section 28*c* preferably has the form of a bolt head, such as a standard hex-head bolt head. The body tube 22 may have different sizes and dimension depending on the requirements of a particular use environment. In the arrangement depicted in the drawings, the body tube has an axial length of 4 inches from the end wall 30 to the open end 32 and is made of metal, such as stainless steel, sufficient to endure harsh operating environments.

The switch assembly 24 has a generally cylindrical outer form factor when assembled and fits into the first section 28*a* of the inner bore 28. The switch assembly 24 includes a primary magnet 34 disposed at a first end of the cylindrical form factor. The primary magnet 34 is carried by a retainer 36, which preferably is in the shape of a hollow cylinder 36*a* with an end wall 36*b*. The primary magnet 34 is received within the cylinder 36*a* and attached to the end wall 36*b* by any convenient fastener, such as adhesive. A biasing magnet 38 is disposed in a first cavity 40 within a first end of a cylindrical casing 42 adjacent to the retainer 36 and within the magnetic flux zone of the primary magnet 34. The biasing magnet 38 is separated from the end wall of the retainer 36 by an end wall 44 of the cylindrical casing 42. In a preferred arrangement, each of the primary magnet 34 and the biasing magnet 38 are permanent magnets and have opposite poles facing each other (i.e., north to south) in order to be attracted to each other, and the cylindrical casing 42 is made of an electrically insulating material, such as a plastic.

A push/pull plunger assembly 46 is slidably disposed in a second cavity 48 inside the cylindrical casing 42. A dividing wall 50 of the cylindrical casing 42 separates the second cavity 48 from the first cavity 40. The push/pull plunger assembly 46 includes a piston head assembly 52 and an axial shaft 54 that extends from a first end of the piston head assembly 52 adjacent the dividing wall 50. The shaft 54 extends through a central axial bore 53 through the dividing wall 50, the biasing magnet 38, and the end wall 44, and is connected to the end wall 36*a* of the retainer 36 such that the primary magnet 34 and the piston head assembly 52 move together. The piston head assembly 52 is arranged to shift, such as by sliding, axially inside the second cavity 48. The piston head assembly 52 includes a second biasing magnet 56 encapsulated within a cylindrical body 58 made of an electrically insulating material, such as plastic. The second biasing magnet 56 is preferably arranged to have the same pole facing the opposing pole of the biasing magnet 38 (i.e., north-to-north or south-to-south) in order to be magnetically biased to be repelled away from each other.

A common contact 60, in the form of a thin electrically conductive strip of, for example, copper, is connected to a second end of the piston head assembly 52 by any convenient means, such as a screw 62, so that the common contact moves with the piston head assembly. The common contact 60 extends laterally across the second end of the piston head assembly 52 from a first end on one side (the left side in FIG. 2) to a second end on the opposite side (the right side in FIG. 2). The first end of the common contact is disposed axially between a first circuit contact 64 and a second circuit contact 66. The first circuit contact 64 is spaced apart from the second circuit contact 66 along the longitudinal axis 68 of the switch assembly 24 a distance substantially equal to a stroke length S of the primary magnet 34 and push/pull plunger assembly 46 within the inner bore 28 and the second cavity 48, respectively. Preferably, each of the first section 28*a* of the inner bore and the second cavity 48 has a length along the axis 68 that allows space for the primary magnet 34 and the piston head assembly 52 to move axially back and forth a distance equal to the stroke length S, sufficient to allow the common contact 60 to move exactly the distance from connection with the first circuit contact 64 to connection with the second circuit contact 66, and back.

A header assembly 70 formed of an electrically insulating material sealingly covers a second end of the cylindrical casing 42. The header assembly 70 includes a cylindrical, disc-shaped plug 72 and first, second, and third pins 74, 76, 78 that are electrically conductive extending through the plug 72. The plug 72 is sized to be received within and plug the second end of the cylindrical casing 42, which is located within the first portion 28*a* of the inner bore 28 of the body tube 22 adjacent the second portion 28*b*. Thus, the entire switch assembly 24 is preferably contained within the first portion 28*a* of the inner bore 28. The first pin 74 is electrically connected with the first circuit contact 64. The second pin 76 is electrically connected with the second circuit contact 66. In a preferred arrangement, the first circuit contact 64 is a distal end of the first pin 74, and the second circuit contact 66 is a distal end of the second pin 76. Each pin 74, 76 is substantially axially aligned with the longitudinal axis 68. The distal end of each respective pin 74, 76 is bent or angled to form a contact portion that extends transversely, such as orthogonally, to the longitudinal axis 68 and axially spaced apart as described previously. The third pin 78 is connected to a flexible connector, such as a pigtail 80, which is also connected with the common contact 60. The opposite, or proximal, end of each of the pins 74, 76, and 78 extends through an end wall of the plug 72 toward the open end 32 of the body tube 22. Preferably, a seal plug 82 is sealingly disposed in a bore 84 centrally axially aligned through the plug 72. In some applications, it may be desirable to eliminate the seal plug 82 to leave the bore 84 open or to eliminate the bore 84.

The pigtail 80 may be made of any electrically conductive material that is flexible an amount sufficient to allow the common contact 60 to move axially back and forth between the first and second circuit contacts, 64, 66. In a preferred embodiment, the pigtail is made of a flexible wire fabric. Other possible materials may include, for example, carbon fiber reinforced fabrics or plastics. Preferably, although not necessarily, the pigtail 80 is flexible an amount sufficient to minimize any mechanical bias of the piston head assembly 52 toward either of the first or second circuit contacts 64, 66 so that movement of the push/pull plunger assembly 46 is controlled substantially only by the various magnetic forces between the magnets 34, 38, and 56.

In operation, the magnets 34, 38, and 56 operate to bias the push/pull plunger assembly 46 into a normal first position toward the header assembly 70, in which the common contact 60 is biased into contact against the first circuit contact 64 and does not contact the second circuit contact 66. Preferably, the magnets 34, 38, 56 are selected and arranged to maintain uninterrupted contact between the common contact 60 and the first circuit contact 64 during a seismic acceleration loading of up to ten G's. When a target magnet (not shown) is moved to within a selected minimum distance of the closed end 30 of the body tube 22, the target magnet overcomes the biasing forces of the biasing magnet 38, 56 and pulls the primary magnet 34, and subsequently the entire push/pull plunger assembly 46, to a second position toward the closed end 30. In the second position, the common contact 60 is biased into contact against the second circuit contact 66 and does not contact the first circuit contact 64. Preferably, the space between the primary magnet 34 and the biasing magnet 38 is minimized by having only the end wall 44 and the end wall of the retainer 36 disposed between the two magnets, and the length of the shaft 54 is minimized accordingly, which provides a strong enough magnetic attraction between the magnets 34, 38 to help maintain the common contact 60 in uninterrupted contact with the first contact 64 at a seismic acceleration of up to 10 G's.

The end seal assembly 26 in a preferred arrangement provides a hermetic seal for the open end 32 of the body tube 22 to keep moisture and/or other harmful materials out of the switch assembly 24, while allowing electrical lead wires electrically coupled or connected with the contacts 60, 64, 66, to be accessible for connection to control wiring and protecting the electrical lead wires from being pulled or moved in a manner that might compromise the various connections along the various circuits. The end seal assembly 26 includes a hermetic seal 90, a hollow crush ring 92, a crush ring compression device 94, a ferrule 96, a jam nut 98, and a potting 100, all preferably disposed in the second and third portions 28*b*, 28*c* of the inner bore.

The hermetic seal 90 includes a circular disc 102 with three holes extending therethrough and a hollow tube 104 disposed through each hole. Each hollow tube 104 has a first end 104*a* disposed on an interior side of the disc facing the switch assembly 24 and a second end 104*b* disposed on an exterior side of the disc facing toward the open end 32. Each hollow tube 104 is arranged and has an inside diameter sized to receive the proximal end of one of the pins 74, 76, and 78 in a friction fit. Optionally, a fourth hollow tube 106 is disposed through a fourth hole through the circular disc 102 and can be left open to conduct pressure testing prior to subsequent sealing. The tube 106 preferably has a larger inside diameter than the other three tubes 104. The disc 102 is attached to the inner surface of the second portion 28*b* of the inner bore 28 by a seal ring 108 sufficient to sealingly withstand specified pressure and other conditions. The seal ring 108 may be a solder ring, adhesive, welding, or another sealing material suitable to withstand the specified pressure and/or other conditions. The pins 74, 76, and 78 preferably are attached to the respective one of the tubes 104 on the interior side of the disc 102 by, for example, soldering or welding.

A cable 110 includes three separate electrical wires 110*a*, 110*b*, and 110*c*. Each wire 110*a*, 110*b*, 110*c* is connected with a respective one of the tubes 104 by, for example, an end pin 111 that is received within the tube and attached with solder. The cable 110 is arranged for being connected with control and/or sensing circuits elsewhere by completing the first and second circuits formed by the contacts 60, 64, 66, pins 74, 76, and 78, and tubes 104 in any sufficient manner. Of particular relevance for the purposes of this disclosure is that the cable 110 extends along the second and third portions 28*b*, 28*c* of the inner bore 28 from the tubes 104 to and out of the open end 32 of the body tube 22.

The crush ring compression device 94 is a plug that locks into the inner bore 28 by, for example, screwing into the third portion 28*c* of the inner bore 28, and has a central opening 112 through which the cable 110 extends. Preferably, the crush ring compression device 94 has a cylindrical plug body 114 with exterior threads 116 that engage complementary interior threads 118 on the inner annular surface of the third portion 28*c* of the inner bore 28. A nipple 120, preferably in the form of a short cylindrical section of smaller diameter than the plug body 114, projects axially from a central portion of an exterior side of the plug body 114 toward the open end 32 and has external threads. The central opening 112 preferably defines a short cylindrical bore section 122 inside the nipple 120, an inner tapered portion 124 preferably in the form of an inner conical bore section extending from an inner end of the cylindrical bore section to the inner end of the plug body 114, and an outer tapered section 126 preferably in the form of an outer conical bore section extending from an outer end of the cylindrical bore section to an outer end of the nipple 120.

The crush ring 92 functions as a gasket seal between the inner end of the crush ring compression device 94 and a radially projecting inner annular ledge 128 of the body tube 22 that connects the second portion 28*b* and the third portion 28*c* of the inner bore 28. The crush ring 92 is made of a sealing material appropriate for the intended use environment of the proximity switch 20, and in one embodiment preferably is formed of a hollow stainless steel ring having the form of a hollow tube with a circular longitudinal axis, for use in harsh, high temperature, and/or nuclear environments. The crush ring 92 preferably has an outer diameter substantially equal to an inner diameter of the third portion 28*c* of the inner bore 28.

The potting 100 completely fills the space between the crush ring compression device 94 and the hermetic seal 90. Preferably, the potting 100 also seeps into and fills any space between the hermetic seal 90 and the end wall of the plug 72 of the header assembly 70, for example, by flowing through the tube 106. The potting 100 preferably is formed of a sealing material that can flow into and/or be compressed into all of the spaces and crevices to form a water-tight hermetic seal in the inner bore 28 to prevent at least liquids and harmful particulates from entering the switch assembly 24. In a preferred arrangement, the potting 100 is a flowable resin, such as an epoxy or similarly flowable material, l that subsequently sets or hardens into a rigid mass.

In a preferred method of assembly, the potting 100 is inserted while in a fluid state into the inner bore 28 through the open end 32 after the switch assembly 24 and the hermetic seal 90 are installed as described above. Preferably, the inner bore 28 is filled with enough potting 100 to completely fill all the space between the crush ring compression device 94 and the hermetic seal 90. In one method, the potting is filled to the thread 118 furthest from the open end 32 after the crush ring 92 is inserted into the inner bore 28, and the crush ring compression device 94 compresses the potting 100 to sealingly fill any crevices and openings around the crush ring compression device 94, such as between the threads 116 and 118 and between the cable 110 and the central opening 112. Preferably the potting 100 subsequently sets or hardens to form a solid rigid seal or plug in the open end 32 of the body tube 22 between the crush ring compression device and the hermetic seal 90.

The ferrule 96 is an elongate tubular member that fits snuggly around the cable 110 and wedges into the outer tapered bore section 126. In a preferred arrangement, the ferrule 96 is made of PolyEtherEtherKetone (PEEK) and is bullet-shaped, having a cylindrical body 132, a radially inwardly tapered nose 134 at one axial end of the cylindrical body 132, a radially inwardly tapered annular shoulder 136 at the opposite axial end of the cylindrical body 132, and an axial through bore 138 extending through the opposite axial ends.

The jam nut 98 holds the ferrule 96 in a locked position wedged into the outer tapered bore section 126. The jam nut 98 preferably is formed of a cylindrical tube 142 having locking flanges 144, 146 at opposite axial ends of the cylindrical tube. Each locking flange 144, 146 projects radially inwardly from the respective axial end of the cylindrical tube 142. The locking flange 144 includes inner annular threads that engage the external threads on the nipple 120, and the locking flange 146 is sized to engage the annular shoulder 136 of the ferrule 96. The jam nut 140 fits over and around the ferrule 96, and the locking flange 146 presses against the annular shoulder 136 to urge the ferrule 96 into wedged engagement against the outer tapered bore section 126 as the locking flange 144 is screwed onto the nipple 120. Simultaneously, radially inwardly wedging force on the ferrule 96 from the outer tapered bore section 126 also tightens the ferrule 96 around the cable 110, thereby further forming a seal around the cable 110. The ferrule 96 and jam nut 98 also work together as assembly to lock the cable 110 in a fixed position within the central opening 112 to prevent movement or forces applied to the cable outside of the proximity switch 20 from being transferred to the potting 100 or the various electrical connections with the switch assembly 24 at, for example the tubes 104, which could compromise the integrity of the electrical circuits.

In a preferred arrangement, the cylindrical casing 42 has one or more openings, such as windows 150, and preferably two opposing windows 150, through the sidewall of the casing arranged to allow visual inspection of the plunger assembly 46 and header 70 during assembly of the switch assembly 24. An insulating sleeve 152 fits snugly around the exterior of the cylindrical housing 42 to cover the windows 150 and reduce or prevent electrical arcing between the contacts 60, 64, 66 and the body tube 22. The insulating sleeve is preferably made of an electrically insulating material, such as Kapton® film by E.I. du Pont de Nemours and Company or similar materials, and has a longitudinal slit 154 to aid in assembly. After being fitted onto the cylindrical casing 42, opposite edges of the sleeve extending along the slit 154 preferably are connected together by an adhesive patch 156, also preferably made of an insulating material, such as Kapton® tape by E.I. du Pont de Nemours and Company or similar materials.

Figure 3:
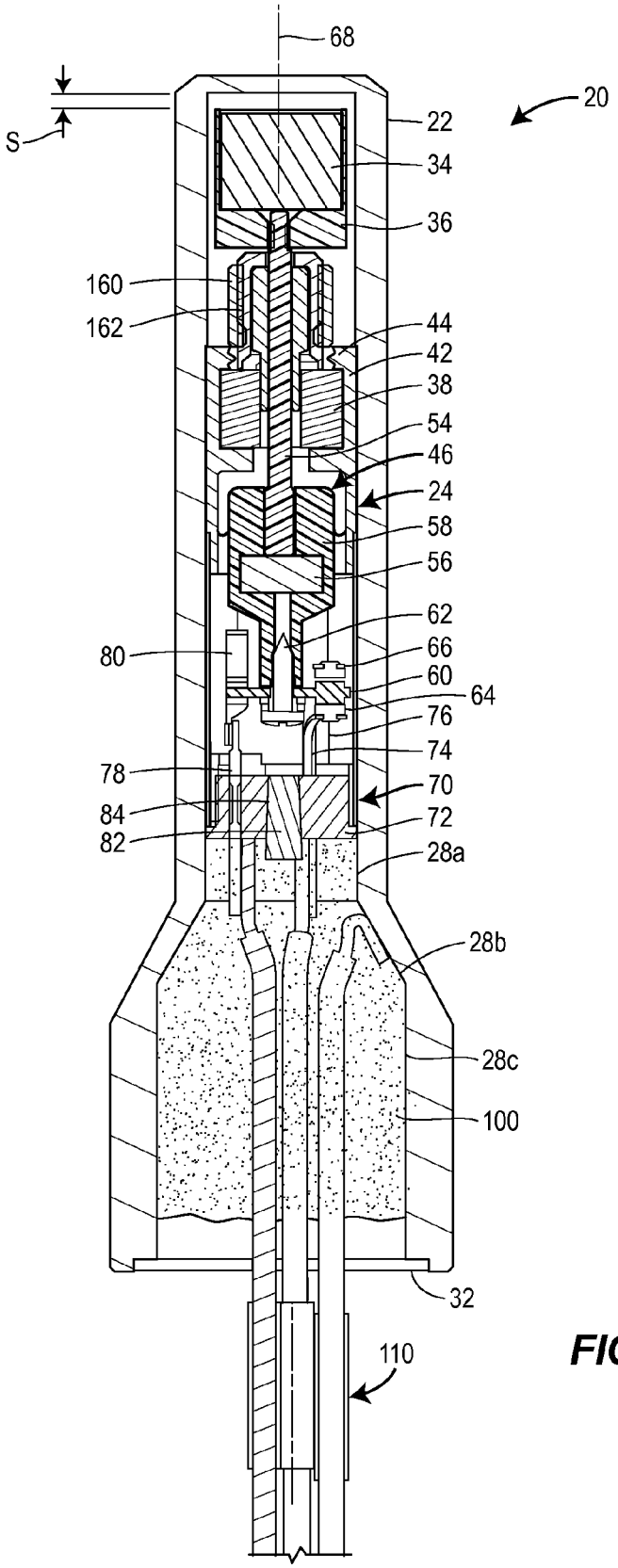
FIG. 3 is a cross-sectional view along a longitudinal axis of the proximity switch showing the inclusion of an optional flux sleeve and an optional alternative end seal.

Turning now to FIG. 3, the proximity switch 20 is shown with the addition of an optional flux sleeve 160, preferably in the form of a hollow metal cylinder, disposed between the primary magnet 34 and the end wall 44 of the cylindrical sleeve 42. The flux sleeve 160 is preferably made of a ferrous material, and both separates the primary magnet 34 from the biasing magnet 38 to reduce the attractive magnetic pull between the magnets and focuses the magnetic flux field of the magnets. The flux sleeve 160 is preferably attached to the cylindrical sleeve 42 by a threaded connection with a threaded stud 162 extending from the end wall 44 toward the primary magnet 34. The flux sleeve 160 may be screwed on to the threaded stud 162. The attractive force between the primary magnet 34 and the biasing magnet 38 may be adjusted within a range of forces by varying the axial length of the flux sleeve 160 and/or the material of the flux sleeve and/or the length of the stud 162. In addition, the piston rod 54 in the proximity switch 20 of FIG. 3 is longer than the piston rod 54 in the proximity switch 20 of FIGS. 1 and 2 in order to accommodate the added space required for the flux sleeve 160. The proximity switch 20 in FIG. 3 is also shown with the option of not including the end seal assembly 26. Rather the header assembly 70 and the electrical cable 110 are encapsulated in the open end 32 of the body tube 22 only with the potting 100 or other sealing material, such as an epoxy resin or plastic. The body tube 22 also is shown without the optional exterior threads and a tapered or conical second portion 28*b* of the inner bore 28. Other portions of the proximity switch shown in FIG. 3 are substantially as previously shown and described in relation to FIGS. 1 and 2, the description of which is not repeated here.

While the proximity switches 20 disclosed herein are generally shaped like a bolt and have form factors of generally circular cylindrical outer form to easily allow the body tube 22 to be screwed into a common tapped cylindrical bore, the proximity switches 20 are not limited to being circular cylindrical. Rather, the components of the proximity switches 20 may have almost any cross-sectional shape as long as the primary magnet 34 and the push/pull plunger assembly 46 can move axially toward and away from a ferrous or magnetic target to move the common contact 60 from the first contact 64 to the second contact 66 and back as described herein.

INDUSTRIAL APPLICABILITY

The proximity switches disclosed herein are useful in industrial process control systems, and in some arrangements are particularly well adapted for use in nuclear applications, underwater, and in other caustic and/or harsh operating environments. Numerous modifications to the proximity switches disclosed herein will be apparent to those skilled in the art in view of the foregoing description. Accordingly, this description is to be construed as illustrative only and is presented for the purpose of enabling those skilled in the art to make and use the proximity switches and to teach the best mode of carrying out same. The exclusive rights to all modifications which come within the scope of any claims are reserved. All patents, patent applications, and other printed publications identified in this foregoing are incorporated by reference in their entireties herein.

We claim:

1. A proximity switch comprising:

a body tube having a blind bore, a closed end, and an open end;

a magnetic proximity switch assembly disposed inside the blind bore;

a hermetic seal covering the blind bore between the magnetic proximity switch assembly and the open end;

a crush ring disposed against an annular shoulder defined in a surface of the blind bore between the hermetic seal and the open end;

a crush ring compression device having a threaded plug body that screws into the open end of the blind bore and sealingly engages the crush ring; and a potting filling any space between the crush ring compression device and the hermetic seal;

wherein the hermetic seal, the potting, and the crush ring compression device seal the blind bore and protect the magnetic proximity switch during pressurization and submergence testing.

2. The proximity switch of claim 1, wherein the crush ring compression device compresses the potting and the crush ring.

3. The proximity switch of claim 1, wherein the crush ring comprises a hollow tube having a circular longitudinal axis.

4. The proximity switch of claim 1, wherein an electrical cable electrically is connected with the magnetic proximity switch assembly, the crush ring compression device has a central bore, and the electrical cable extends from the hermetic seal through the central bore of the crush ring compression device.

5. The proximity switch of claim 4, further comprising a ferrule arranged to lock the electrical cable in the central bore.

6. The proximity switch of claim 5, further comprising a jam nut arranged to lock the ferrule into the central bore.

7. The proximity switch of claim 1, wherein the hermetic seal comprises a disc sized and shaped complementary to the blind bore, and a tube extending through the disc, wherein the tube has a first end adjacent the magnetic proximity switch and receiving an electrical contact therein, and wherein an outer annular periphery of the disc is sealed to an inner surface of the blind bore.

8. The proximity switch of claim 7, wherein the electrical cable is electrically coupled to the tube.

9. The proximity switch of claim 7, further comprising a second tube extending through the disc, wherein the second tube receives a second electrical contact therein.

10. The proximity switch of claim 4, wherein the central bore comprises a cylindrical portion and a first tapered portion extending from the cylindrical portion to a first end of the plug body engaged against the crush ring, wherein the crush ring compression device compresses the potting into the central bore.

11. The proximity switch of claim 5, wherein the central bore comprises a second tapered portion, and the ferrule is wedged into the second tapered portion.

12. A proximity switch comprising:

a body tube having a first bore with an open end;

a proximity switch assembly disposed inside the bore;

a plug having a body that fits inside the open end and locks against an annular wall of the bore, the body having a second bore therethrough;

an electrical lead electrically coupled with the proximity switch assembly and extending through the second bore;

a ferrule surrounding the electrical lead and disposed inside the second bore; and a jam nut coupled with the plug and urging the ferrule into sealing contact with the second bore and locking the electrical lead in a fixed position within the second bore.

13. The proximity switch of claim 12, wherein the ferrule has a tapered nose that is wedged within the second bore.

14. The proximity switch of claim 12, wherein the plug comprises a nipple extending from an exterior end of the plug body axially opposite the proximity switch assembly, wherein the second bore has a tapered portion extending through the nipple, and the ferrule is wedged into the tapered portion by the jam nut.

15. The proximity switch of claim 14, wherein the nipple has exterior threads, and the jam nut screws onto the exterior threads.

16. The proximity switch of claim 12, wherein the tapered portion forms a conical bore.

17. The proximity switch of claim 12, wherein the ferrule comprises Poly Ether Ether Ketone.

18. The proximity switch of claim 12, wherein the ferrule sealingly engages the second bore and the electrical lead thereby forming a seal around the electrical lead in the second bore.

19. The proximity switch of claim 12, wherein the jam nut comprises an first inward radial flange that engages the ferrule, and optionally, a second inward radial flange comprising threads that engage the plug.

20. A proximity switch assembly comprising:

a primary magnet;

a plunger including a piston head spaced from the primary magnet and a piston rod connecting the piston head and the primary magnet;

an electrical contact carried by the piston head and arranged to open and/or close an electrical circuit upon movement of the piston head; and a first biasing magnet located adjacent the piston rod between the primary magnet and the piston head;

a second biasing magnet operatively coupled to and encapsulated within the piston head;

wherein the biasing magnet is arranged to bias the primary magnet axially along the piston rod either toward or away from the first and second biasing magnets, the plunger and the primary magnet are arranged to move axially in relation to the first biasing magnet, and no flux sleeve is disposed between the primary magnet and the biasing magnet.

21. The proximity switch of claim 20, wherein the primary magnet is carried by a retainer attached to the piston rod, the first biasing magnet is carried within a retainer body comprising a wall disposed between the first biasing magnet and the retainer, and no spacer is disposed between the wall and the retainer.

22. The proximity switch of claim 20, wherein the primary magnet is carried by a retainer attached to the piston rod, the first biasing magnet is carried within a retainer body comprising a wall disposed between the first biasing magnet and the retainer, and no ferrous material is disposed between the wall and the retainer.

* * * * *